United States Patent [19]

Stockman

[11] Patent Number: 4,671,455

[45] Date of Patent: Jun. 9, 1987

[54] DONATION BOX

[75] Inventor: Wayne A. Stockman, Plymouth, Ind.

[73] Assignee: W.A.S. Vending, Inc., Plymouth, Ind.

[21] Appl. No.: 742,439

[22] Filed: Jun. 7, 1985

[51] Int. Cl.[4] ..... A47G 29/00

[52] U.S. Cl. ..... 232/1 D; 232/4 R; 232/43.2

[58] Field of Search ..... 232/1 D, 1 E, 2, 4 R, 232/43.2; 220/400, 408; 446/8

[56] References Cited

U.S. PATENT DOCUMENTS

| | | | |
|---|---|---|---|
| 706,231 | 8/1902 | Goldman | 232/1 D |
| 837,442 | 12/1906 | Whitehead | 232/1 D |
| 1,626,840 | 5/1927 | Kaufman | 232/4 |
| 2,404,043 | 7/1946 | Dilley | 232/1 D |
| 4,232,474 | 11/1980 | Dyer | 446/8 |

*Primary Examiner*—Robert P. Swiatek

*Attorney, Agent, or Firm*—Barnes & Thornburg

[57] ABSTRACT

A donation box having a collection receptacle receiving chamber and a merchandise compartment, wherein the constituent panels are interengaged in assembled form in a manner which permits merchandise in its compartment to maintain the box parts interengaged.

9 Claims, 6 Drawing Figures

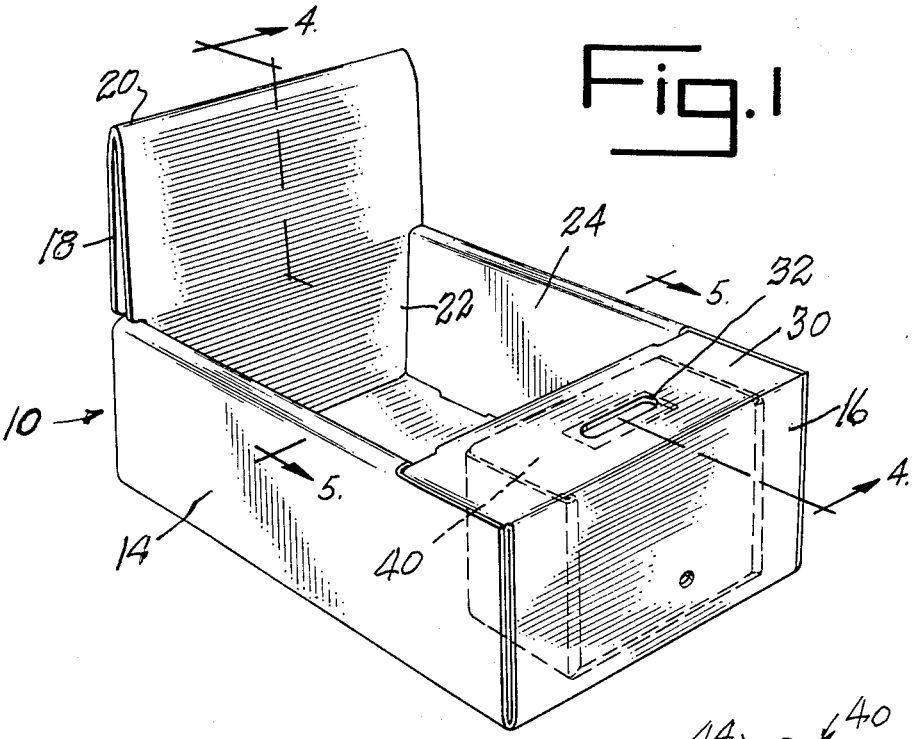
Fig. 1
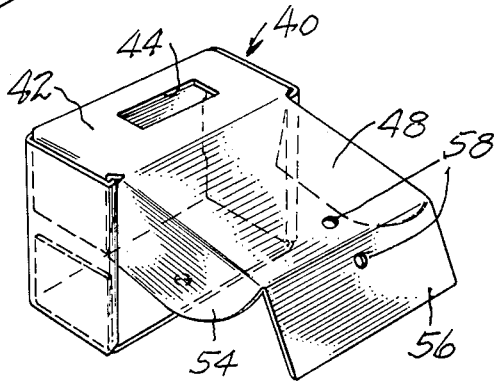
Fig. 3
Fig. 2
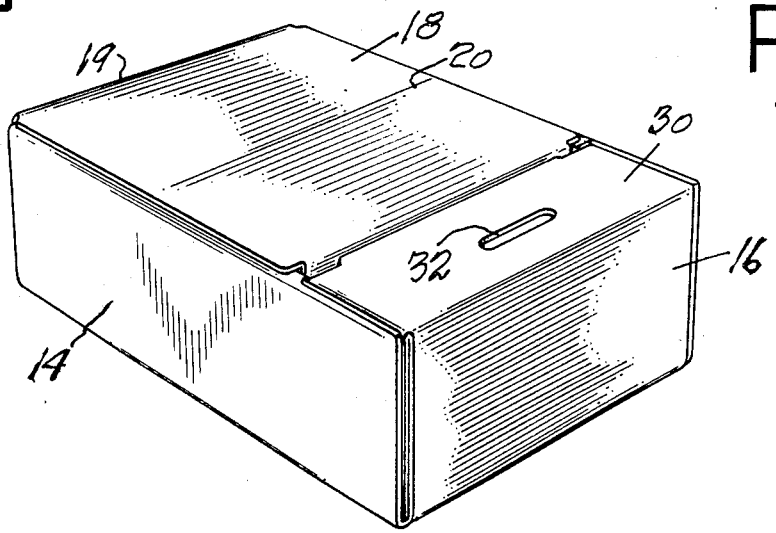

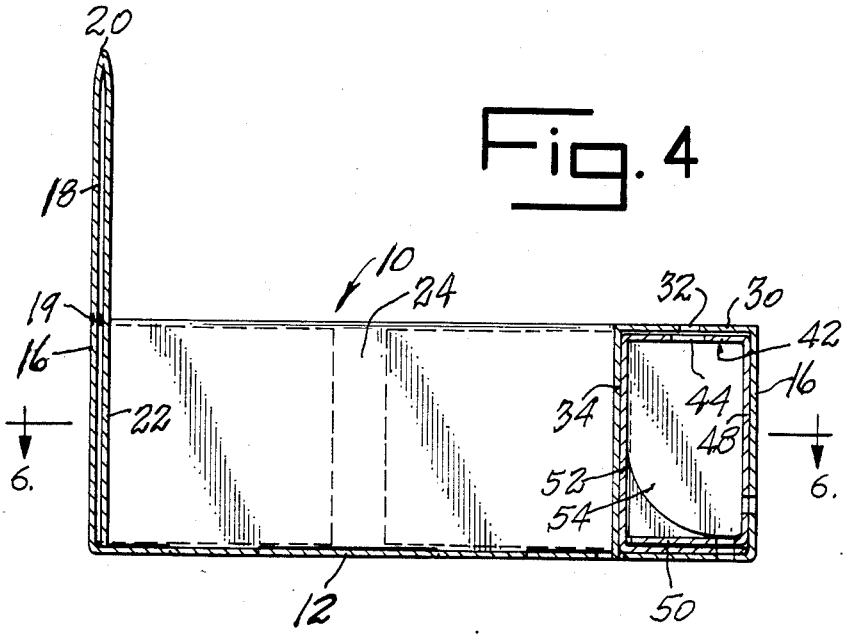
Fig. 4
Fig. 5
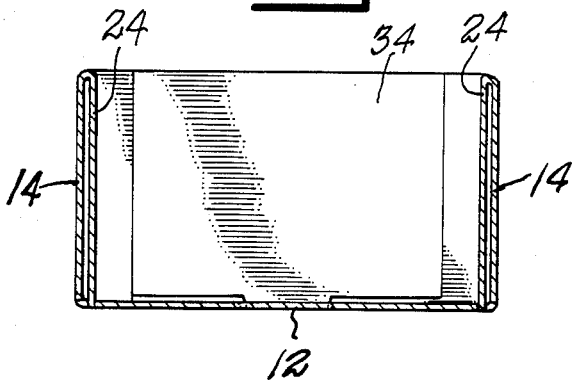
Fig. 6
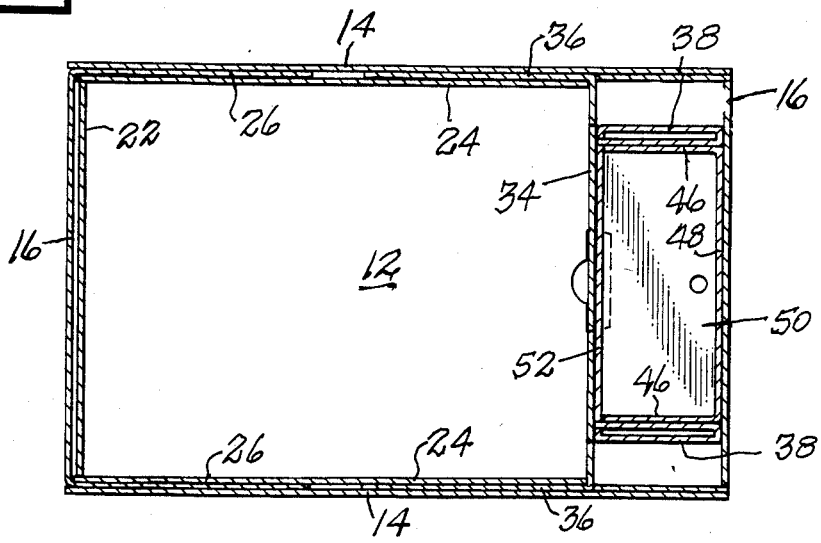

DONATION BOX

SUMMARY OF THE INVENTION

This invention relates to improvements in a donation box of the type employed to solicit and receive donations, as in behalf of charitable organizations. Such boxes are commonly used to receive donations and to provide means to display and make available candy and other merchandise as partial compensation for a donation. Such boxes are usually displayed in retail establishments or other places frequented by the public in readily accessable locations, and usually receive coins as donations.

The primary object of the invention is to provide a construction of a donation box which is quickly converted between closed and open positions and into which candy and other merchandise can be filed for convenient and transportable condition when closed, and which exposes the candy or other contained items and the coin receiving slot when open.

A further object is to provide a donation box in which a coin receptacle is removable and is inserted in the manner which resists pilferage thereof by concealing the access means thereto from would-be pilferers.

A further object is to provide a donation box which has interfitting parts of a nature which reenforces the construction thereof, exposes data identifying the organization soliciting donations, and which is strong, of light weight, which provides convenience to persons making donations and makes available to such persons candy or other merchandise which a donator can easily reach while making a donation.

Other objects will be apparent from the following specifications.

BRIEF DESCRIPTION OF THE DRAWINGS

FIG. 1 is a perspective view of the donation box in open or use condition.

FIG. 2 is a perspective view of the donation box in its closed or storage position.

FIG. 3 is a perspective view of a removably mounted donation receptable carried by the donation box.

FIG. 4 is a longitudinal vertical sectional view of the donation box taken on line 4—4 of FIG. 1 and illustrating the box in its open or use condition.

FIG. 5 is a transverse sectional view taken on line 5—5 of FIG. 1.

FIG. 6 is a horizontal sectional view taken on line 6—6 of FIG. 4.

DESCRIPTION OF THE PREFERRED EMBODIMENTS

Referring to the drawings, the box 10, which preferably may be formed of paper board or corrugated paper board or plastic material of semi-rigid nature, is characterized by a bottom panel 12, side panels 14, end panels 16 and a top panel 18. Top panel 18 is preferably formed integrally with one end panel 16 and is provided with a crease at 19 to accommodate selected position thereof as between the vertical open position illustrated in FIGS. 1 and 4 and the horizontal closed position thereof illustrated in FIG. 2. The panel 18 is also provided with a crease 20 to facilitate selected position thereof as between the closed position illustrated FIG. 2 and the open position illustrated in FIGS. 1 and 4. The free end portion 22 of top panel 18 is preferably of slightly less width than the remaining portion thereof to accommodate insertion thereof between the side walls 14 when the box is in its open position illustrated in FIGS. 1 and 4, or insertion thereof into the box as seen in its closed position of FIG. 2. The opposite side walls 14 are characterized by downwardly inturned wall portions 24, which extend for a portion of the length thereof and to the end wall 16 from which the top panel 18 projects. The end panel 16 from which the top panel 18 projects may include and have folded therefrom supplemental side panels 26 adapted to bear against the inner surfaces of the respective side walls 14 and to be confined in contact with the sides 14 by the inturned side panels 24.

The end panel 16 shown at the right in FIGS. 1 and 2, has formed integral therewith and folded therefrom the top panel 30 of a donation box receiver chamber, which is characterized by a coin receiving slot 32. The coin receiving chamber is completed by a downturned panel 34 and the box sides 14 and bottom 12. Supplemental side panels 36 project from opposite sides of the downturned panel 34 and bear against the inner surfaces of the side panels 14, as best seen in FIG. 6, while being confined in that position by the inturned side panels 24. If desired, the top panel 18 may terminate in a downturned flange, not shown, to facilitate maintenance of the panel 18 in closed position illustrated in FIG. 2. Spaced partitions 38 may be secured to the box end 16 within the chamber defined by top panel 30, side and end walls 16, bottom 12 and panel 34 to form guides in the event coin receptacle 40 is of a dimension less than width of the box 10.

The coin receptacle 40 may be of the construction illustrated in FIG. 3. Receptacle 40 is preferably formed of paper board, corrugated board or plastic sheet material and is characterized by a top 42 having an opening 44 therein, preferably slightly larger than and adapted to register with the coin slot 32 when the coin receptacle is in operative position while the box is closed. The coin receptacle also includes end walls 46, side walls 48, and 52, and bottom 50. Wall 48 may be free to swing between an open position as seen in FIG. 3 and a closed position when operatively positioned within the box. Wall 48 may have side flanges 54 which may be inserted into the coin receptacle when the receptacle is closed, and may include an end flange 56 to overlie the bottom panel 50 when the coin receptacle is closed. The coin receptacle may be positioned within the box as shown in FIG. 4 with its wall 48 bearing against the adjacent end wall 16 of the container, or may be reversed to bear against the panel 34.

When the box is assembled and is open as shown in FIGS. 1 and 4 and contains candy or other merchandise, the parts of the box are substantially self-locking, and the coin receptacle is fully confined and effectively retained. Thus the candy or contents in the container, when fully or partially filling the container, hold in place effectively the top panel 18 in its vertical position, the inturned side panels 24 and the flanges 36 of panel 34. The coin slot 32 will be of a size to limit access for pilfering purposes so as to retain the coins collected within the coin receptacle.

Access to the compartment containing the coin receptacle is normally limited to a condition in which candy or other merchandise is removed so as to permit the cover panel 18 to be released from its vertical position seen in FIGS. 1 and 4. Release of the cover from operative FIG. 1 position permits the inturned side panels 24 to be swung out of the container to a substantially vertical position at which the supplemental panels 36 are released so that the panel 34 of the receptacle-receiving compartment may be swung open to provide access to the receptacle 40 and removal of the receptacle from the container. Alternatively, assuming that the wall 48 of the coin receptacle is positioned adjacent to panel 34 of the receptacle compartment, the receptacle wall 48 may be swung to open position illustrated in FIG. 3 to facilitate removal of coins from the receptacle. If desired, access openings 58 may be formed in wall 48 and flange 56 of the receptacle to facilitate manual manipulation of the wall 48 from its closed position to its open position illustrated in FIG. 3.

From the foregoing it will be seen that the container provides concealed enclosure of a coin receptacle into which coins may be easily applied and from which coins may not normally be removed. While in condition for use the contents of the box, such as candy or other merchandise, hold the component parts of the box in operative position in which the various parts interfit and reenforce each other. An observer of the construction, while in its normal open position containing candy or other merchandise, cannot observe the manipulation of the respective parts required to open the box and its coin receptacle compartment. At the same time the construction is such that no latching or closing means separate from the components of the box need be provided. Also, the knowledgeable persons who service the box to supply candy and merchandise thereto, and to collect coins therein, can open the coin receptacle compartment quickly and easily so that the time required to service the box and to collect coins deposited therein is minimal.

While the preferred construction of the box has been illustrated and described, it will understood that changes in the construction may be made within the scope of the appended claims without departing from the spirit of the invention.

I claim:

1. A donation box having a merchandise compartment and a receptacle compartment therein, said box having a bottom, side walls, and end walls, said receptacle compartment having a top wall with a coin slot therein and an inner panel folded from said top wall to extend between the side walls of the box, and at least one flange carried by the inner panel of said receptacle compartment, with at least one of said side walls having a downwardly inwardly extending flange for releasably confining the at least one adjacent inner panel flange between said side wall flange and the adjacent side wall.

2. A donation box as defined in claim 1, including a top panel which spans said merchandise compartment, and which may be be swung from a box-closing position to a vertical box-open position serving to confine said side wall flange to operative position alongside the side wall by which it is carried.

3. A donation box as defined in claim 2, wherein a portion of said top panel in said vertical box-open position extends vertically above an opening of said merchandise compartment.

4. A donation box as defined in claim 2, wherein said top panel includes a free end portion of less width than a remaining portion of said top panel, to allow said free end portion to accommodate insertion thereof between said side walls when said top panel is in said vertical box-open position.

5. A donation box as defined in claim 1, having a downwardly inwardly extending flange carried by each side wall, one end wall of said box carrying flanges at opposite sides thereof each receivable between the adjacent side wall and the side wall flange adjacent thereto.

6. A donation box as defined in claim 1, further including a coin receptacle within said receptacle compartment and having an opening registering with said coin slot, said coin receptacle including a side wall shiftable between a closed position and a coin-releasing open position.

7. A donation box having a merchandise compartment and a receptacle compartment therein, said box having a bottom, side walls, end walls and a top panel adapted to span said merchandise compartment, said receptacle compartment having a top wall with a coin slot therein and an inner panel folded from said top wall to extend between the side walls of the box, a coin receptacle within said receptacle compartment and having an opening registering with said coin slot, and flanges carried by the inner panel of said receptacle compartment and releasably interlocked with said box side walls, and having a downwardly inwardly extending flange carried by each side wall to releasably confine the adjacent inner panel flange between said last named side wall flange and the adjacent side wall.

8. A donation box as defined in claim 7, wherein said top panel may be swung from a box-closing position to a vertical box-open position serving to confine said side wall flanges to operative position alongside the side walls by which they are carried.

9. A donation box having a merchandise compartment and receptacle compartment therein, said box having a bottom, side walls, end walls and a top panel adapted to span said merchandise compartment, said receptacle compartment having a top wall with a coin slot therein and an inner panel folded from said top wall to extend between the side walls of the box, a coin receptacle within said receptacle compartment and having an opening registering with said coin slot, and flanges carried by the inner panel of said receptacle compartment and releasably interlocked with said box side walls and having a downwardly inwardly extending flange carried by each side wall, one end wall of said box carrying flanges at opposite sides thereof each receivable between the adjacent side wall and a side wall flange adjacent thereto.

* * * * *